US011375779B2

(12) United States Patent
Bonke

(10) Patent No.: US 11,375,779 B2
(45) Date of Patent: Jul. 5, 2022

(54) GEMSTONE ARRANGEMENT AND METHOD FOR PRODUCING A GEMSTONE ARRANGEMENT

(71) Applicant: Realization Desal AG, Oberwil (CH)

(72) Inventor: Michael Bonke, Oberwil (CH)

(73) Assignee: REALIZATION DESAL AG, Oberwil (CH)

( * ) Notice: Subject to any disclaimer, the term of this patent is extended or adjusted under 35 U.S.C. 154(b) by 0 days.

(21) Appl. No.: 17/057,014

(22) PCT Filed: Jan. 29, 2019

(86) PCT No.: PCT/EP2019/052077

§ 371 (c)(1),
(2) Date: Nov. 19, 2020

(87) PCT Pub. No.: WO2019/223907

PCT Pub. Date: Nov. 28, 2019

(65) Prior Publication Data

US 2021/0112930 A1 Apr. 22, 2021

(30) Foreign Application Priority Data

May 22, 2018 (DE) ..... 102018208021.6

(51) Int. Cl.
*A44C 17/00* (2006.01)
*A44C 27/00* (2006.01)

(52) U.S. Cl.
CPC ..... *A44C 17/003* (2013.01); *A44C 17/006* (2013.01); *A44C 27/00* (2013.01)

(58) Field of Classification Search
CPC ..... A44C 17/002–003; A44C 17/006; A44C 27/00
See application file for complete search history.

(56) References Cited

U.S. PATENT DOCUMENTS

| | | | |
|---|---|---|---|
| 2,447,407 A | 8/1948 | Grain | |
| 2,450,620 A | 10/1948 | Speicher | |
| 4,809,417 A | 3/1989 | Normann, Jr. | |
| 5,454,234 A | 10/1995 | Karmeli | |

(Continued)

FOREIGN PATENT DOCUMENTS

| | | | |
|---|---|---|---|
| BE | 891475 A | 3/1982 | |
| CN | 1377618 A * | 11/2002 | ..... A44C 17/006 |
| DE | 114760 C | 11/1900 | |

(Continued)

OTHER PUBLICATIONS

Translation of CN-1377618-A (Year: 2002).*

(Continued)

*Primary Examiner* — Matthew P Travers
(74) *Attorney, Agent, or Firm* — Tucker Ellis LLP

(57) ABSTRACT

The invention relates to a gemstone arrangement, that comprises a first gemstone element, a second gemstone element, which is connected to the first gemstone element, and at least one decorative element, which is arranged between the first gemstone element and the second gemstone element. Furthermore, the invention relates to a method for producing the gemstone arrangement. A further aspect of the invention relates to a jewel with a gemstone arrangement.

16 Claims, 7 Drawing Sheets

(56) References Cited

U.S. PATENT DOCUMENTS

Figure 1:
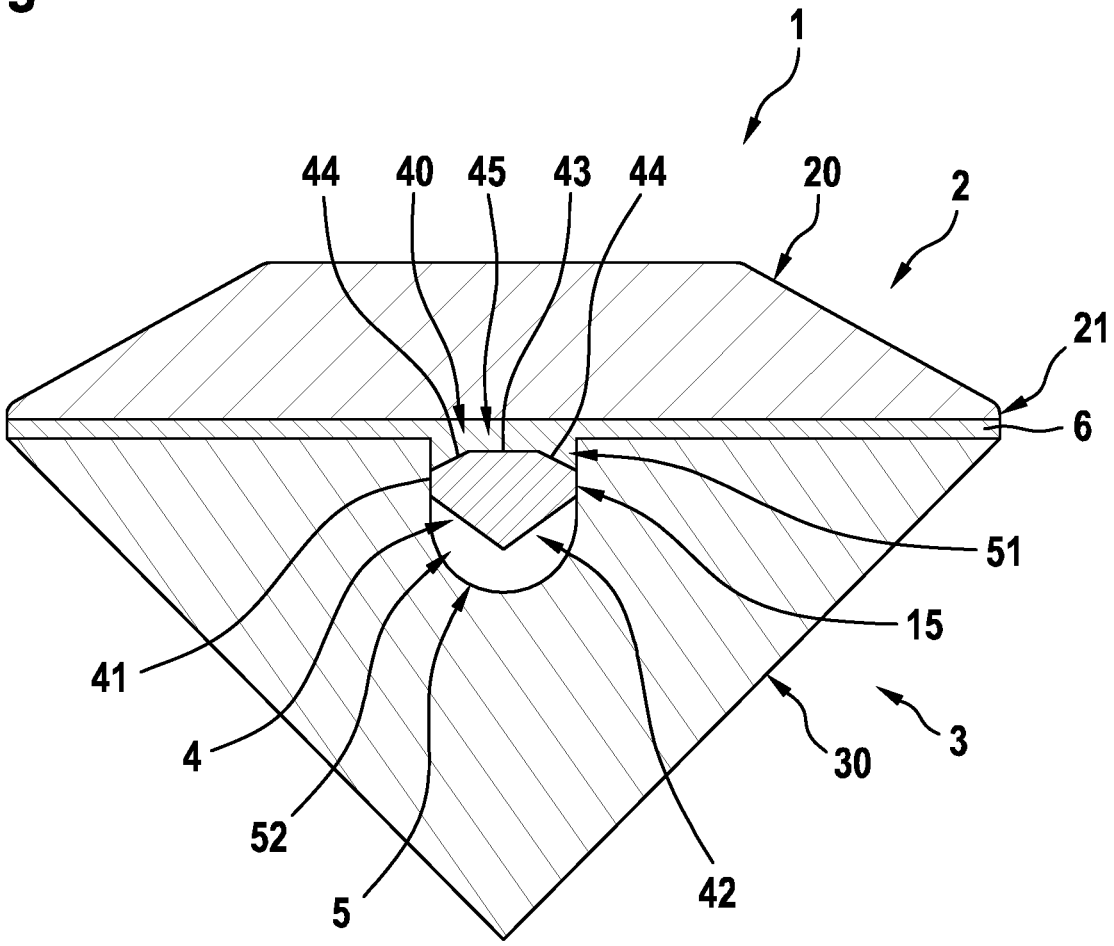

| | | | | |
|---|---|---|---|---|
| 6,649,009 | B1 * | 11/2003 | Kim | A44C 17/003 156/257 |
| 2005/0274144 | A1 * | 12/2005 | Goughnour | A44C 17/003 63/32 |

FOREIGN PATENT DOCUMENTS

| | | | |
|---|---|---|---|
| DE | 4237 | A6 | 4/1953 |
| DE | 2152412 | A | 4/1973 |
| DE | 2256955 | A | 5/1974 |
| DE | 3149149 | A1 | 6/1983 |
| DE | 29622296 | U1 | 2/1997 |
| DE | 202005019551 | U1 | 6/2006 |
| DE | 102011119270 | A1 | 5/2013 |
| WO | 03094650 | A1 | 11/2003 |

OTHER PUBLICATIONS

Translation of DE-2256955-A1 (Year: 1974).*
International Search Report and Written Opinion from corresponding International Application No. PCT/EP2019/052077 dated Mar. 3, 2019, 12 pages.
Office Action from corresponding German Application No. 10 2018 208 021.6 dated Jan. 10, 2019.

* cited by examiner

GEMSTONE ARRANGEMENT AND METHOD FOR PRODUCING A GEMSTONE ARRANGEMENT

RELATED APPLICATION DATA

This application is a National Phase Application of International Application No. PCT/EP2019/052077 filed Jan. 29, 2019, which claims benefit of German Application No. DE 10 2018 208 021.6 filed May 22, 2018.

The invention relates to a gemstone arrangement and a method for producing a gemstone arrangement. The invention also relates to a jewel with a gemstone arrangement. The gemstone arrangement is in particular a precious stone and/or semi-precious stone arrangement.

Gemstones, especially semi-precious stones or precious stones, are often used in a cut form. For example, a jewel with brilliant-cut diamonds is known. Due to the respective cut form of the gemstones, their optical properties can be adjusted, so that an improved appearance of the gemstones and thus of a jewel with a gemstone is achieved.

It is an object of the invention to propose a new type of gemstones, in particular semi-precious stones or precious stones, with an improved appearance. It is further an object of the invention to flexibly adjust the optical properties of a gemstone, in particular of a semi-precious stone or precious stone, and thus to influence the light guidance in the gemstone.

This solution to this object is achieved by a gemstone arrangement, which comprises a first gemstone element, a second gemstone element, and at least one decorative element. Here, the first gemstone element and the second gemstone element are connected to one another. The decorative element is arranged between the first gemstone element and the second gemstone element. The gemstone elements are of natural origin or artificially produced. Particularly preferably, the gemstone arrangement is a semi-precious stone arrangement, wherein the first gemstone element is understood as a first semi-precious stone element and the second gemstone element as a second semi-precious stone element. According to a further preferred embodiment of the invention, the gemstone arrangement is a precious stone arrangement, wherein the first gemstone element is understood as a first precious stone element and the second gemstone element as a second precious stone element.

Due to the gemstone arrangement according to the invention, the gemstone elements connected to one another are combined with an additional decorative element, so that the appearance of the gemstone arrangement is improved by the decorative element. In particular, the first gemstone element and the second gemstone element are connected to one another in such a way that the decorative element is embedded or implanted in the gemstone arrangement. Thereby, the visual impression is created that the decorative element is seamlessly and completely surrounded by the gemstone arrangement, as if the decorative element were a natural inclusion that has been present in a gemstone since its creation. Furthermore, the gemstone arrangement represents a completely new "type of setting" of a decorative element, which allows for a better visual image. The decorative element is inserted in the gemstone arrangement, which acts as a "carrier stone", where it is held completely freely and without metal mounts, which would always optically hide a part of the decorative element. This is particularly advantageous when a gemstone, in particular a semi-precious stone or precious stone, is used as the decorative element. By arranging the decorative element between the first gemstone element and the second gemstone element, settings (e.g. gold settings), which are typically used for receiving a gemstone, can be dispensed with.

Especially when the decorative element is a gemstone, in particular a semi-precious stone or precious stone, the light guidance in the gemstone arrangement is changed by the provision of the gemstone, so that a completely new appearance is achieved. In particular, the light guidance in the gemstone arrangement can be influenced as a function of the position and the optical properties of the gemstone within the gemstone arrangement, so that this results in a variety of new appearances.

The first gemstone element and/or the second gemstone element are preferably each formed such that they each correspond to a part of a gemstone. In other words, the first gemstone element and/or the second gemstone element preferably each have the outer (three-dimensional) shape of a part of a gemstone. Particularly preferably, the first and/or the second gemstone element can each correspond to one-half of a gemstone, in particular of the same gemstone. For example, with regard to the outer shape, the first gemstone element may correspond to a crown and the second gemstone element to a pavilion with a girdle of a gemstone. It is however also possible that the first gemstone element corresponds to a crown with a girdle and the second gemstone element to a pavilion of a gemstone. Further, it is possible that the first gemstone element corresponds to a crown with a part, in particular one half, of a girdle of a gemstone and the second gemstone element to a pavilion with a part, in particular one half, of a girdle of a gemstone.

The first gemstone element and the second gemstone element are preferably each formed in such a way that these have together, i.e. in the connected state, the outer (three-dimensional) shape of a gemstone. In other words, the first gemstone element and the second gemstone element are preferably each formed in such a way that the formed gemstone arrangement has the outer shape of a gemstone.

Here, the decorative element is not only visible from above in the top view, but also, for example, from the side through the inclined crown facets of the gemstone arrangement. In other words, the decorative element can also be viewed in perspective from all possible angles.

In the context of the invention, unless otherwise mentioned, a gemstone, in particular a semi-precious stone or precious stone, is preferably understood as a gemstone that is cut (i.e. not a rough stone), in particular faceted. This applies as well to the gemstone elements as to the decorative element, when the latter is a gemstone.

In the context of the invention, a precious stone (for the gemstone elements or the decorative element) is understood in particular as a gemstone that meets the following four criteria:

1. rarity
2. Mohs hardness (precious stone hardness) greater than or equal to 5, preferably greater than or equal to 6, particularly preferably greater than or equal to 7
3. transparency
4. refractive index greater than or equal to 1.56, preferably greater than or equal to 1.7

In particular, rubies, sapphires and emeralds are precious stones.

A glass part is here preferably not understood as a gemstone (semi-precious stone, precious stone or other gemstone) due its chemical composition and structure, even if the glass part is composed of a material (starting material) which in its raw state is classified as a gemstone (semi-precious stone, gemstone or other gemstone). The glass part can be for example a quartz glass, wherein the quartz glass does not count among the gemstones, even if quartz (starting material) is a gemstone.

In the context of the invention, the gemstone, in particular semi-precious stone or precious stone, can be natural or synthetic.

In particular, the decorative element is arranged in a recess of the gemstone arrangement.

The decorative element can be a gemstone, in particular a semi-precious stone or a precious stone, or a metal inlay, for example a gold inlay. In particular, the decorative element can be a diamond.

If the gemstone arrangement has a plurality of decorative elements, any arbitrary combination of semi-precious stones, precious stones, other gemstones and metal inlays is possible.

By using a plurality of decorative elements, a photo of a loved person, a zodiac sign, an arbitrary symbol or a signature can for example be inserted in the gemstone arrangement. For example, a plurality of decorative elements can be arranged in such a way that these form a cross or the victory symbol.

In addition, the first gemstone element can be understood as an upper gemstone element and the second gemstone element as a lower gemstone element.

Preferably, the first gemstone element and the second gemstone element are connected to one another over an entire surface.

Direct Connection Between the First Gemstone Element and the Second Gemstone Element Preferably, the first gemstone element and the second gemstone element are connected directly to one another, so that the decorative element is embedded in the gemstone arrangement. Thereby, the first gemstone element and the second gemstone element form a volume body with a continuous outer surface that encloses a volume. The decorative element is implanted in the formed volume body.

"Direct" with regard to the connection of the first gemstone element to the second gemstone element means in particular that at most only one connecting material, which connects the gemstone elements to one another, is provided at one or each connection point/contact point between the first gemstone element and the second gemstone element. This means that a connection of the first gemstone element to the second gemstone element over their periphery, for example by means of a holding element that presses/holds the first gemstone element and the second gemstone element together, as well as a connection of the first gemstone element to the second gemstone element by means of a connecting material at one or each connection point/contact point between the first gemstone element and the second gemstone element are to be understood as direct connections.

In other words, when the first gemstone element is connected directly to the second gemstone element by means of a connecting material between the first gemstone element and the second gemstone element, only the connecting material and no further component are arranged in between.

To connect the first gemstone element and the second gemstone element, a connecting intermediate layer is preferably used, which is placed between the first gemstone element and the second gemstone element. Only the intermediate layer is present at one or each connection point/contact point between the first gemstone element and the second gemstone element. This connection is therefore to be understood in the context of the present invention as a direct connection, since no component is arranged between the first gemstone element and the second gemstone element.

Specification of the Intermediate Layer

The connecting intermediate layer can preferably be formed as an adhesive film, laminating film or liquid adhesive, which is hardened in the assembled state.

The connecting intermediate layer is advantageously made transparent. This creates an optical conductivity around the decorative element.

The first gemstone element and/or the second gemstone element preferably has a refractive index that lies between 1.54 and 1.65.

The connecting intermediate layer preferably has a refractive index of 1.45 to 1.48.

A laminating film made of ethyl vinyl acetate (EVA) or polyvinyl butyral (PVB) is preferably used as the connecting intermediate layer. The laminating film is transparent and preferably has a refractive index, which lies between 1.45 and 1.48.

Particularly preferably, the connecting intermediate layer has a refractive index which is greater than or equal to 0.9 of the refractive index of the first gemstone element and less than or equal to the refractive index of the first gemstone element.

Particularly preferably, the connecting intermediate layer has a refractive index that is greater than or equal to 0.9 of the refractive index of the second gemstone element and less than or equal to the refractive index of the second gemstone element.

In particular, the first gemstone element and the second gemstone element are (directly) glued to one another over an entire surface.

Specification of the Recess in the Case of a Direct Connection

The decorative element is preferably arranged in a recess, which is formed in the first gemstone element and/or the second gemstone element.

The decorative element is particularly preferably arranged in a recess formed completely in one of the gemstone elements, in particular in the second gemstone element. "Completely" means that the recess is only formed in one of the gemstone elements. The decorative element can be arranged completely (only) in the recess or partially protrude beyond the recess.

Alternatively, a first region of the recess can preferably be provided in the first gemstone element and a second area of the recess in the second gemstone element.

In the case of a gemstone arrangement with a plurality of decorative elements, at least one recess can be formed in the first gemstone element and at least one further recess in the second gemstone element. However, it is also possible that all recesses are provided only in the first gemstone element or only in the second gemstone element.

Direct Contact of the Connecting Intermediate Layer with a Region of an Upper Portion of the Decorative Element According to a preferred embodiment of the invention, in the case of a direct connection of the first gemstone element to the second gemstone element by means of the connecting intermediate layer, a region of an upper portion of the decorative element is in direct contact with the intermediate layer. The connecting intermediate layer advantageously covers the recess, in particular completely. Preferably, the upper portion of the decorative element is embedded in the intermediate layer. Here, the decorative element is particularly preferably a gemstone, in particular a semi-precious stone or a precious stone.

The upper portion of the decorative element preferably faces toward the first gemstone element, wherein the first gemstone element is the part that is arranged in such a way that the light strikes thereon. In other words, the upper portion of the decorative element preferably faces toward the first gemstone element, wherein the first gemstone element is the part, on which the light strikes, when the gemstone arrangement is provided in a jewel. The first gemstone element can also be viewed as a cover element (upper gemstone element) and the second gemstone element as a base (lower gemstone element).

When the recess is formed in the second gemstone element, the upper portion of the decorative element faces away from the second gemstone element compared to the lower portion of the decorative element.

In the case of a gemstone, in particular a semi-precious stone or a precious stone, as the decorative element, the difference in the optical densities between the intermediate layer and the region of the crown of the gemstone in contact with the intermediate layer is reduced compared to that between the air and a region of the crown of the gemstone in contact with the air. Thus, when the intermediate layer abuts on the crown of the gemstone, the angle of total reflection at the interface between the intermediate layer and the crown is reduced. As a result, less light is totally reflected at this point, that is, more light enters the gemstone provided as the decorative element, or exits the gemstone again. The incoming light is passed on to the pavilion of the decorative element and reflected at the pavilion back to the crown. Due to the intermediate layer provided on the crown, the light can exit at this point the decorative element unhindered without being reflected. In addition, the diffraction and the partial reflection of the light are reduced during the transition at the interface between the two optical media (the connecting intermediate layer and the decorative element). Thus, more light can reach the viewer.

In the case of a gemstone, one understands as an upper part or rather a crown the portion that is located above a girdle of the gemstone. Below the girdle of the gemstone is the lower part or the pavilion. The girdle corresponds to a circumferential edge between the crown and the pavilion in the case of (cut) gemstones or a dividing edge between the crown and the pavilion. In particular, the region of the upper portion comprises a table of the gemstone. Correspondingly, a region of the lower portion of the gemstone comprises a taper or a culet of the stone.

Carrier Element

According to a further preferred embodiment of the present invention, a carrier element is arranged between the first gemstone element and the second gemstone element. In the carrier element, a recess is formed, in which the decorative element is arranged. The carrier element is connected to the first gemstone element and the second gemstone element, so that the decorative element is embedded in the gemstone arrangement. In other words, the first gemstone element, the second gemstone element and the carrier element form a volume body, in which the decorative element is implanted. Preferably, the carrier element is formed as a glass part. The glass part can be formed from mineral glass or plexiglass, for example. Thereby, the object of making a recess is shifted from the first gemstone element and/or second gemstone element to the carrier element. This has the advantage that in the case of large-scale production much faster production processes (e.g. pressing or punching, for example of prefabricated glass parts) can be used, which can replace laborious manufacturing processing (e.g. the polishing of the recess). For this reason, the carrier element with the recess can be prefabricated and connected to each of the first and second gemstone elements without effort. The carrier element is preferably not formed as a gemstone.

The carrier element is advantageously made transparent.

The recess is preferably formed completely in the carrier element, in particular the glass part. This means that the recess is preferably not formed in the first gemstone element or the second gemstone element.

The carrier element, in particular the glass part, is preferably formed in such a way that, in the connected state to the first gemstone element and/or the second gemstone element, the carrier element has the same dimension perpendicular to the direction of connection with the first gemstone element and/or the second gemstone element. In other words, the glass part is formed in such a way that in the gemstone arrangement a periphery of the carrier element is flush with a periphery of the first gemstone element and/or the second gemstone element.

Alternatively, the carrier element, in particular the glass part, can be formed in such a way that the carrier element is arranged in a recess of the first gemstone element and/or the second gemstone element.

It is also possible that a first recess for receiving a first decorative element and a second recess for receiving a carrier element, in particular a glass part, with a recess and a second decorative element arranged therein are formed in the first gemstone element and/or second gemstone element.

From a production standpoint, this can be particularly advantageous if the gemstone arrangement shall have a plurality of decorative elements and shall be formed individually. For example, for producing a gemstone arrangement, which shall have for instance a standard symbol and an individually formed arrangement of decorative elements, a prefabricated carrier element, in particular a glass part, with recesses for receiving the decorative elements in the form of the standard symbol can be used. The carrier element is inserted in a recess formed in the first and/or second gemstone element. The individually formed arrangement of decorative elements can be achieved by arranging the elements in further recesses in the first and/or second gemstone element. Particularly in the case of complicated standard symbols, by providing a prefabricated carrier element for receiving the decorative elements for forming the standard symbol, the complexity of producing the gemstone arrangement is considerably reduced.

The carrier element, in particular the glass part, is preferably connected to the first gemstone element by means of a connecting intermediate layer, wherein a region of an upper portion of the decorative element is in direct contact with the intermediate layer. Thereby, the total reflection, the diffraction and partial reflection of the light during the transition at the interface between the two optical media (the connecting intermediate layer and the decorative element) is reduced. Thus, more light can reach the viewer.

The connecting intermediate layer advantageously covers the recess, in particular completely. The upper portion of the decorative element is preferably embedded in the intermediate layer. The decorative element is particularly preferably a gemstone, in particular a semi-precious stone or precious stone.

The upper portion of the decorative element preferably faces toward the first gemstone element, wherein the first gemstone element is the part which is arranged in such a way that the light strikes thereon. In other words, the upper portion of the decorative element preferably faces toward the first gemstone element, wherein the first gemstone element is the part, on which the light strikes when the gemstone arrangement is provided in a jewel.

The carrier element, in particular the glass part, is also preferably connected to the second gemstone element by a further connecting intermediate layer. The advantages achieved by the connecting intermediate layer and the abovementioned explanations regarding the connecting intermediate layer in the embodiment of the invention with an intermediate layer between the first gemstone element and the second gemstone element also apply to the embodiment that a connecting intermediate layer between the carrier element and the first gemstone element and/or a further connecting intermediate layer between the carrier element and the second gemstone element is provided.

The intermediate layer between the first gemstone element and the carrier element and the further intermediate layer between the carrier element and the second gemstone element can preferably be formed identically.

The first gemstone element and the carrier element are preferably connected to one another, in particular glued to one another, over an entire surface. Preferably, the second gemstone element and the carrier element are connected to one another, in particular glued to one another, over an entire surface.

Specification of the Recess

Preferably, a region of the recess below a contact area between the recess and the decorative element has only air or vacuum. Thereby, the impression of a decorative element floating in the air is given to a viewer. In particular, the recess and the decorative element have complementary shapes at the contact area between the decorative element and the recess.

The region of the recess below the contact area preferably faces toward the pavilion of the decorative element.

When the decorative element is a gemstone, in particular a semi-precious stone or a gemstone, the double reflection of the light in the pavilion of the gemstone is made possible due to the air or the vacuum below the contact area between the recess and the decorative element. The gemstone thus has an optimal ratio of reflected light and an optimal sparkle.

According to an alternative preferred embodiment, the decorative element can be arranged in the recess contactlessly. "Contactlessly" means that there is no contact or no direct contact between the decorative element and the recess (the wall of the recess). "Directly" means here that no component or connecting material of any kind is arranged between the decorative element and the recess. The decorative element can be completely embedded in the connecting intermediate layer. This can particularly be of advantage, when the decorative element is a metal inlay. In this way, the metal inlay can stably and precisely be positioned in the arrangement, and at the same time give the impression that it is floating in the air. Such an arrangement of the decorative element can also be advantageous when the decorative element is an elongated gemstone.

Specification of the Gemstone Elements and the Decorative Element

Advantageously, the first gemstone element has a lower refractive index than the second gemstone element. Thus, for example, an element from a first gemstone with a low refractive index (e.g. quartz) can be joined together with an element from a second gemstone with a high refractive index (e.g. zircon). Hence, an optimal light yield is achieved by the gemstone arrangement.

Preferably, the first gemstone element and the second gemstone element have (per se) different colors. In other words, the first gemstone element preferably has (per se) a first color and the second gemstone element has (per se) a second color, which are different from each other. Here, the first gemstone element and the second gemstone element can preferably be formed from different gemstone materials. Alternatively, the first gemstone element and the second gemstone element can be formed from the same gemstone material, but differ in color. For example, both gemstone elements can be formed from topaz, wherein one of which can be artificially colored. The first color is preferably lighter than the second color. Combining gemstone elements of a different color for forming a gemstone arrangement has the advantage that another very attractive or unusual color for the gemstone arrangement and special color effects can arise from two different colors of the gemstone elements. Thus, for example, a first gemstone element made from light blue topaz or aquamarine and a second gemstone element made from dark purple amethyst can be combined. Hence, an "amethyst-aquamarine-hybrid" is obtained, which represents a completely new type of a gemstone (gemstone arrangement), a "combi-stone".

In addition, the decorative element can advantageously have a third color (per se) that is different from the first color of the first gemstone element and the second color of the second gemstone element. The third color can preferably be lighter than the first and/or the second color. The third color is particularly preferably lighter than the first color, which in turn is lighter than the second color. In particular, the decorative element is colorless.

The effect of these embodiments is particularly attractive when the decorative element is a gemstone.

Thus, for example, a white (colorless transparent) diamond against the background of a dark purple amethyst with an upper gemstone element formed from a pink-colored kunzite would shine out of an optically dark purple precious stone as a pink-colored diamond. The pink-colored gemstone element of the "combi-stone" will not appear as pink-colored in itself, as it always appears purple due the dark purple lower gemstone element. However, the white (colorlessly transparent) diamonds are not colored by the lower gemstone element of the amethyst, as no light can penetrate through a well-cut brilliant. Thus, the dark purple color of the lower gemstone element cannot combine with the color of the diamond. In contrast, however, the color of the upper gemstone element can mix with the color of the diamond, as it represents a color filter that lies between the diamond and the viewer. Thus, depending on the choice of the colored stones, one can get all possible color combinations of the decorative elements, which can achieve in interaction with the three-dimensional effect a very spectacular optical effect. In other words, the combination of two differently colored gemstone elements and the inlay of a third-colored decorative element between the two gemstone elements of the gemstone arrangement creates a three-dimensionally positioned decorative element in the gemstone arrangement, which has a striking coloration without artificial coloring. Thus, the effect of a colored gemstone can be achieved without utilizing usual radioactive irradiation with which gemstones are colored, and without subjecting the gemstone to a color coating that is associated with considerable cost and time expenditure. For example, pink-colored diamonds cost about 100 times as much as white (colorless transparent) diamonds. Besides, colored gemstones are perceived by consumers as something "fake" or "processed", so that their price-benefit ratio is classified as poor.

According to a further preferred embodiment of the present invention, the first gemstone element and the second gemstone element are formed from the same precious stone material. Thus, a gemstone arrangement is formed which, in terms of shape, corresponds to a gemstone made of the same material, but has an improved visual appearance due to the embedding of a decorative element. To this end, a gemstone (starting gemstone) can be divided in a simple way into a first gemstone element and a second gemstone element, which are connected to one another after arranging the decorative element in between. This improves the appearance of the starting gemstone.

Preferably, the first gemstone element and/or the second gemstone element has a refractive index that lies between 1.54 and 1.65.

Preferably, the decorative element is a gemstone, which has a higher refractive index than the first gemstone element and/or the second gemstone element. Due to the higher refractive index, the angle of total reflection is higher and thus also the light yield, i.e. the amount of light that is reflected into the viewer's eye, increases. This leads to the first and/or the second gemstone element shining more intensely or rather sparkling or being lightened in color.

The first gemstone element and the second gemstone element are preferably formed in such a way that they have in the connected state the same dimension perpendicular to the connection direction. In other words, the first gemstone element and the second gemstone element are formed in such a way that in the gemstone arrangement a periphery of the first gemstone element is flush with a periphery of the second gemstone element.

Particularly preferably, a plurality of decorative elements is provided, wherein the decorative elements are arranged in corresponding recesses and formed as gemstones, which each have a higher refractive index than the first gemstone element and/or the second gemstone element. In particular, the decorative elements are arranged in a line or a common plane. In other words, the decorative elements can be arranged in a line or have a layer. All the decorative elements are preferably formed identically. In particular in the case of decorative elements formed as gemstones, all gemstones are preferably formed from the same material and/or have the same color and/or the same size and/or the same shape.

Thereby, the effect of the lightening of the first gemstone element and/or the second gemstone element is increased. Thus, a sparkle and a light yield are achieved by the gemstone arrangement, which a gemstone could never achieve in its existing form (without a gemstone incorporated therein).

Preferably, the decorative element is a diamond, in particular a brilliant. In particular, each decorative element is a diamond, especially a brilliant. Since the diamond has the highest refractive index, its angle of total reflection is the highest known in optics and therefore produces the highest amount of light yield.

The lightening effect is particularly advantageous when a first colored gemstone element and/or a second colored gemstone element are used. When, for example, a plurality of diamonds or small brilliants (e.g. in the form of a layer) is inserted between a first colored and/or a second colored gemstone element, a colored arrangement of gemstones is created, which has a natural coloration like another gemstone (e.g. an emerald or aquamarine), but which has a light reflection that is increased and approaches a diamond. Thus, the optical effect of the gemstone arrangement is intensified while maintaining its basic color effect. Thereby, the arrangement of gemstones is lightened and shines more.

The gemstone or the plurality of gemstones is preferably arranged at a height of ⅓ of the total height of the gemstone arrangement, measured from an upper surface of the gemstone arrangement. In other words, an upper surface of the gemstone or the gemstones, respectively, is arranged at a height of ⅓ of the total height of the gemstone arrangement, wherein the height of the gemstone is measured from an upper surface of the first gemstone element. This is particularly advantageous when the first gemstone element is composed of a gemstone material, which suffers from that it swallows too much light and is too dark. For this reason, such gemstone materials that are too dark (almost black) and therefore reflect too little light are not in great demand and are therefore very cheap. As the gemstone is arranged at the above-mentioned height between the first gemstone element and the second gemstone element, the color filter effect is reduced by ⅔. This means that of the color filter, which swallows too much light, only the upper third of the first gemstone element becomes now effective. Thus, the first gemstone element, which is composed of a gemstone material that appears dark due to the high level of light absorption, can suddenly have a radiant color, because ⅓ of the color filter would perhaps result in exactly the ideal color.

The decorative element is preferably a gemstone, in particular a semi-precious stone or a precious stone, which has a smaller pavilion angle than the second gemstone element. In other words, a pavilion angle of the decorative element formed as a gemstone is smaller than a pavilion angle of the gemstone arrangement. In particular, the decorative element is formed here from the same gemstone material as the first gemstone element or the second gemstone element. Particularly preferably, the decorative element, the first gemstone element and the second gemstone element are composed of the same gemstone material. Furthermore, the decorative element, the first gemstone element and the second gemstone element are preferably colored. Due to the steep pavilion angle of the gemstone, the same ratio of the angle of incidence of the light to the total reflection angle is achieved for most of the light, as if a gemstone formed from the same material had itself a very steep pavilion. Thus, the light yield, the sparkle and the luminescence of the gemstone arrangement are improved without having the disadvantages of a steep gemstone. A steep gemstone is in fact disadvantageous because it is very inconvenient to set it in a jewel. For example, a steep gemstone protrudes in rings unintentionally or is usually tilted to the side in pendants due to the steep pavilion. Aside from that, the raw precious stones are often much flatter than the ideal proportions of a gemstone, if this should have a specific size.

The effect achieved by the design of the pavilion angle of the gemstone arrangement described above is particularly pronounced when the first gemstone element and/or the second gemstone element are each composed of a gemstone material, which, in the form of a cut gemstone material, sparkles the more, the steeper its crown angle or pavilion angle is. For example, corundum, i.e. sapphires and rubies, belong to such precious stone materials. These sparkle in the shape of a cut gemstone really nicely only if they have a pavilion depth that is at least 60% to 70%, preferably even up to 80%, of the girdle diameter. However, it is not always possible to maintain these proportions for a specific size of the cut gemstone, so that the cut gemstone does not sparkle optimally. By implanting a gemstone with a steeper pavilion angle than the formed gemstone arrangement, this problem is solved.

The invention further relates to a jewel that comprises a previously described gemstone arrangement and a setting, by means of which the gemstone arrangement is fixed.

The solution to the above-mentioned object is further achieved by a method for producing a gemstone arrangement, the method comprising the steps of providing a first gemstone element, providing a second gemstone element, providing a decorative element, arranging the decorative element between the first gemstone element and the second gemstone element and connecting the first gemstone element to the second gemstone element. Said method for producing a gemstone arrangement is associated with the advantages and explanations mentioned above with reference to the gemstone arrangement.

In other words, the solution to the above-mentioned object is also achieved by a method for producing a gemstone arrangement, the method comprising the steps of arranging a decorative element between a first gemstone element and a second gemstone element and connecting the first gemstone element to the second gemstone element.

In particular, the first gemstone element and the second gemstone element are connected to one another in such a way that the decorative element is embedded in the gemstone arrangement.

Preferably, the first gemstone element and the second gemstone element are connected directly to one another, so that the decorative element is embedded in the gemstone arrangement.

In particular, the first gemstone element and the second gemstone element are directly connected to one another by means of an intermediate layer.

Preferably, the method comprises the steps of making a recess in the first gemstone element and/or the second gemstone element and of arranging the decorative element in the recess. These steps take place before connecting the first gemstone element and the second gemstone element to one another.

Particularly preferably, the recess is formed at the location of a natural inclusion in the first gemstone element and/or second gemstone element. To this end, a gemstone, in particular a semi-precious stone or precious stone, that has a disruptive inclusion, can be divided, in particular sawed, at the height of the inclusion, in order to remove the inclusion. The recess resulting from the removal of the inclusion can be used, in particular after it has been processed, as the recess for receiving the decorative element. Thereupon, a decorative element, in particular a gemstone, can be arranged in the formed recess. This has the advantage that a gemstone, the quality of which would otherwise be reduced due to inclusion, is upgraded.

Alternatively, a recess that is created by removing an inclusion can preferably be filled with the same gemstone material as the first gemstone element and/or the second gemstone element. Thus, the optical effect of the inclusion can disappear.

In addition, the first gemstone element and the second gemstone element are preferably connected directly to one another by means of a connecting intermediate layer, wherein a region of an upper portion of the decorative element is in direct contact with the intermediate layer.

According to an advantageous embodiment of the present invention, a carrier element is arranged between the first gemstone element and the second gemstone element, in which at least one recess is formed. The decorative element is arranged in the recess. The carrier element is connected to the first gemstone element and the second gemstone element, so that the decorative element is embedded in the gemstone arrangement.

Preferably, the carrier element is connected to the first gemstone element by means of a connecting intermediate layer, wherein a region of an upper portion of the decorative element is in direct contact with the intermediate layer. In particular, the decorative element is formed as a gemstone.

The carrier element can furthermore preferably be connected to the second gemstone element by means of a further connecting intermediate layer.

The carrier element is formed in particular as a glass part.

The intermediate layer for connecting the carrier element to the first gemstone element (first intermediate layer) and the further intermediate layer for connecting the carrier element to the second gemstone element (second intermediate layer) can preferably be formed identically.

For providing the first gemstone element, a first gemstone (a stone already cut) can preferably be divided. A part of this can be used as the first gemstone element and connected to the second gemstone element.

Alternatively, a first gemstone element can preferably be connected to the second gemstone element and then be cut. In this exceptional case, the first gemstone element before the connecting step is an element of a gemstone not cut, but sectioned, in particular in a block shape.

Accordingly, a second gemstone (a stone already cut) can preferably be divided to provide the second gemstone element, a part of which is used as the second gemstone element and connected to the first gemstone element.

Alternatively, a second gemstone element can preferably be connected to the first gemstone element and then be cut. In this exceptional case, the second gemstone element before the connecting step is an element of a gemstone not cut, but sectioned, in particular in a block shape.

Particularly preferably, a gemstone is divided into two parts, in particular two halves, which are used as the first gemstone element and the second gemstone element and are connected to one another after arranging (at least) one decorative element in between. In this case, the first gemstone element and the second gemstone element are formed from the same gemstone material and have the same refractive index.

For providing the first gemstone element, a first gemstone (stone already cut) is preferably divided into two parts. Of these, one part is used as the first gemstone element. Furthermore, for providing the second gemstone element, a second gemstone (stone already cut) is preferably divided into two parts, one part of which is used as the second gemstone element.

Alternatively, an element of a first sectioned gemstone, in particular in a block shape, can preferably be connected to one another with an element of a second sectioned gemstone, in particular in a block shape. Then, the two elements are cut so that a gemstone arrangement with a first gemstone element and a second gemstone element is created.

For providing the first gemstone element and/or the second gemstone element, a gemstone can preferably be divided through the middle of a total height of the gemstone and/or a girdle and/or at the height of an inclusion.

Although it is advantageous when the first gemstone element and the second gemstone element are provided in the same way, it is not excluded in the context of the invention that the preparation methods described above can be combined with one another at will. Thus, for example, the first gemstone element can be provided, if necessary, by a part of a divided cut gemstone and the second gemstone element by a sectioned gemstone that is first connected to the first gemstone element and then cut.

Figure 2:
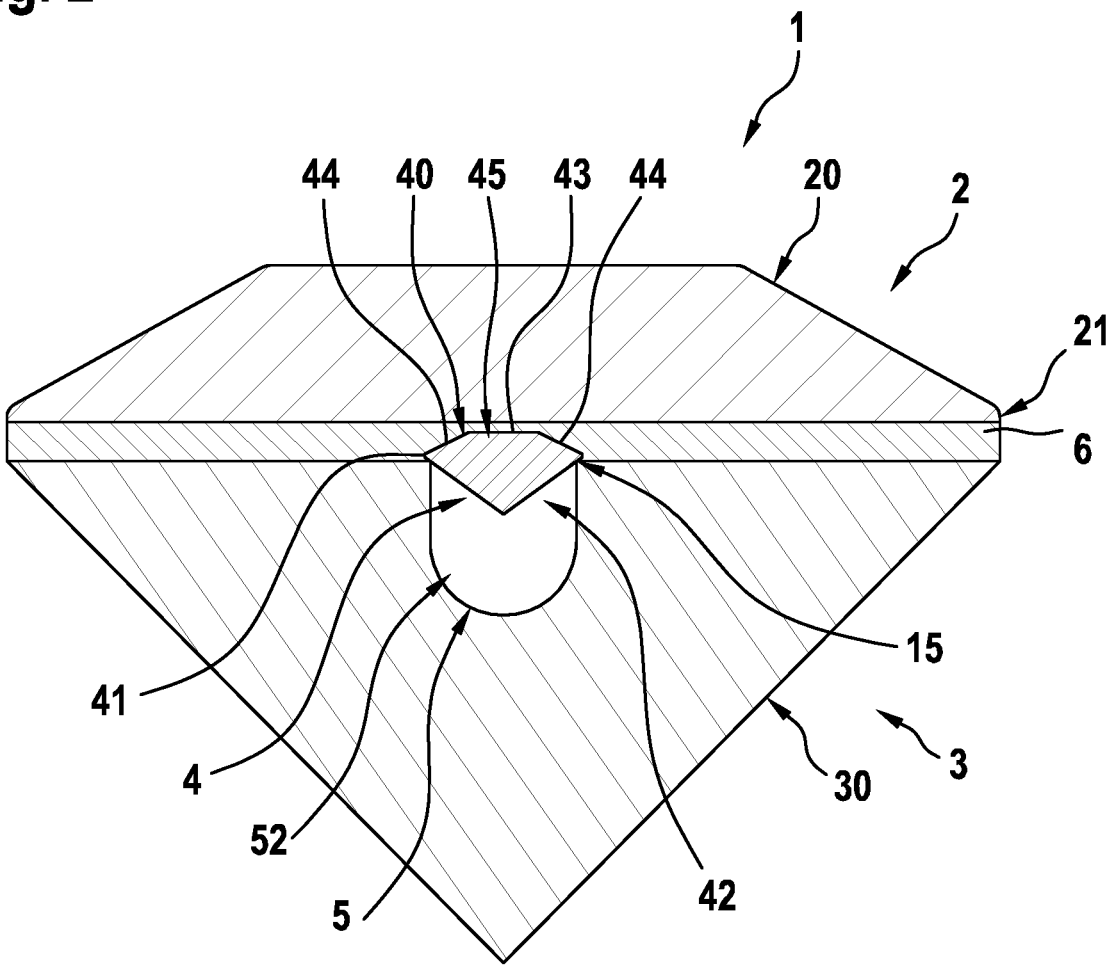
Figure 3:
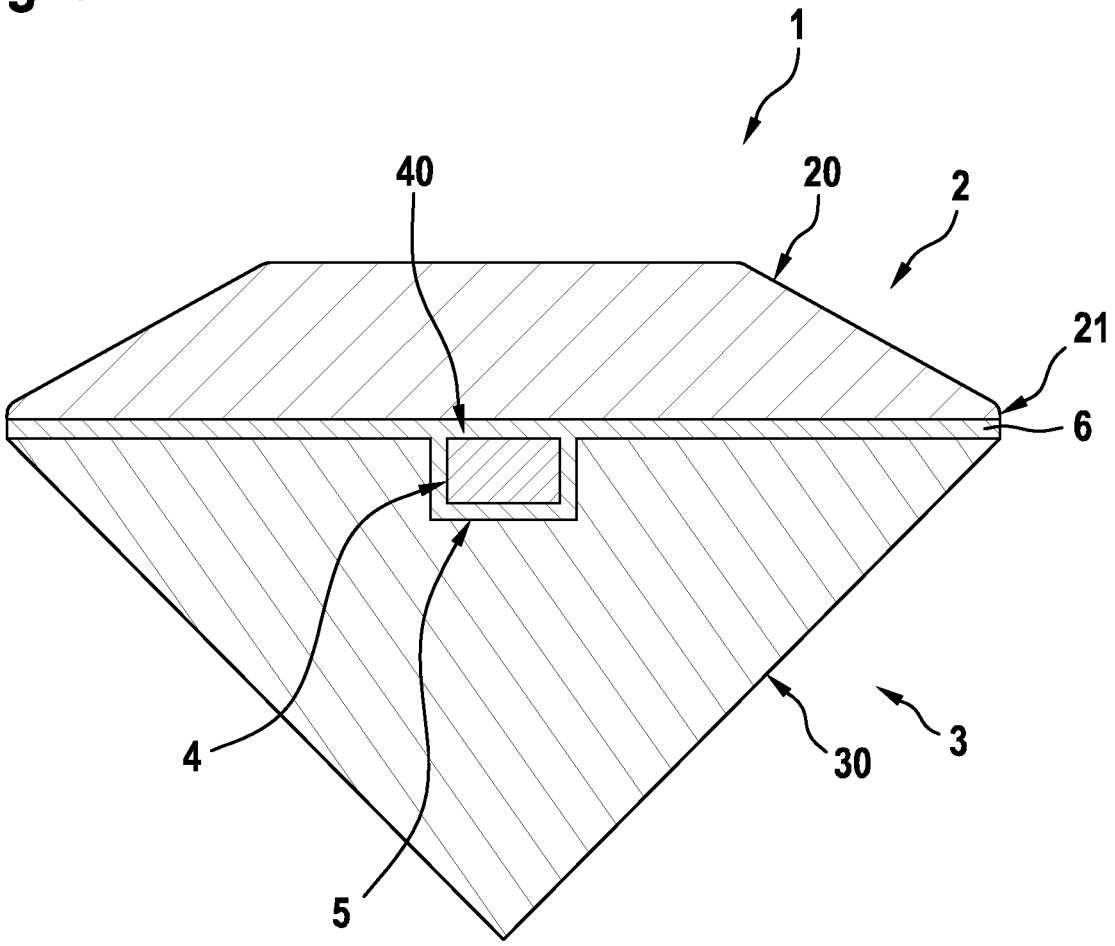
Figure 4:
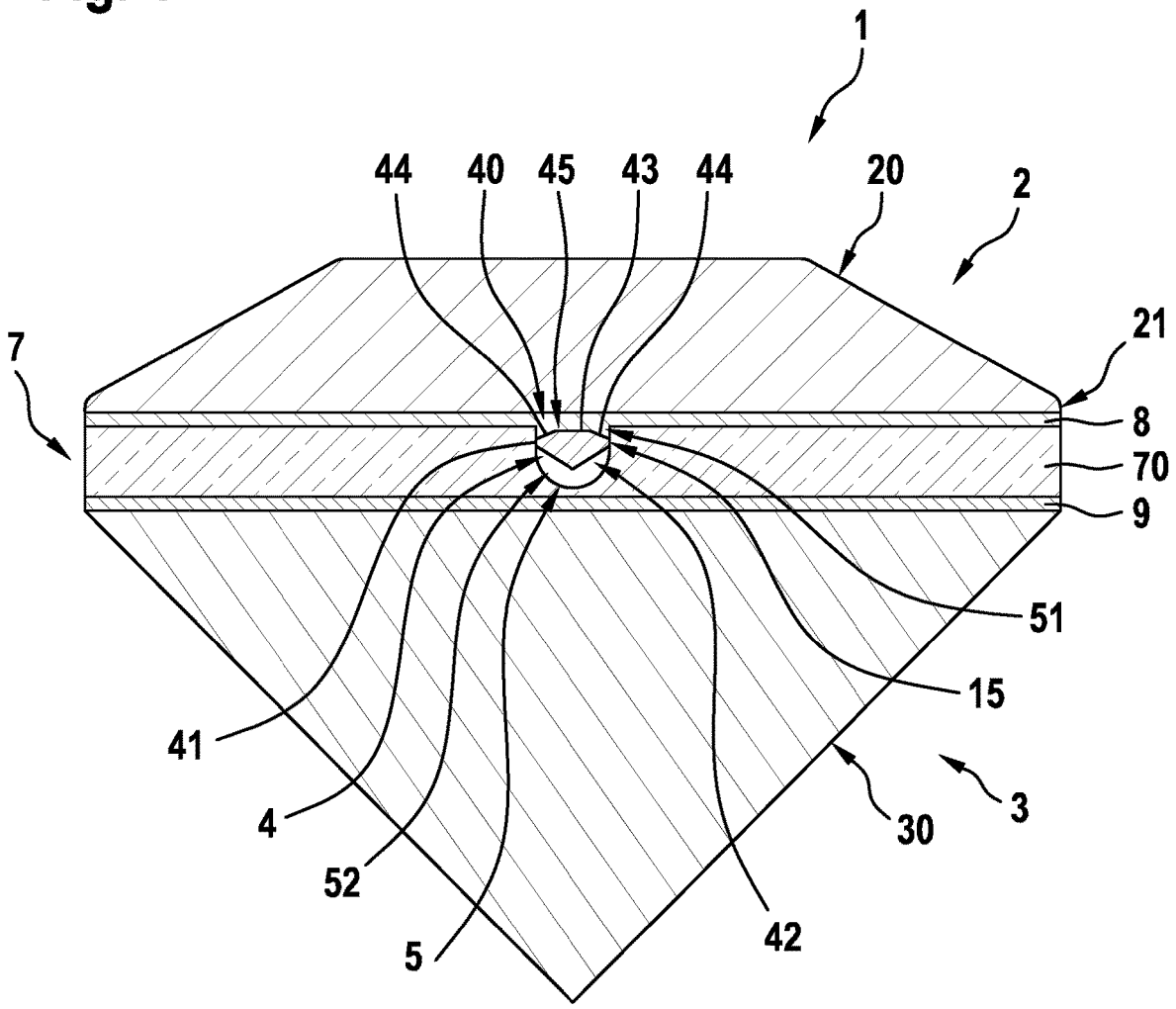
Figure 5:
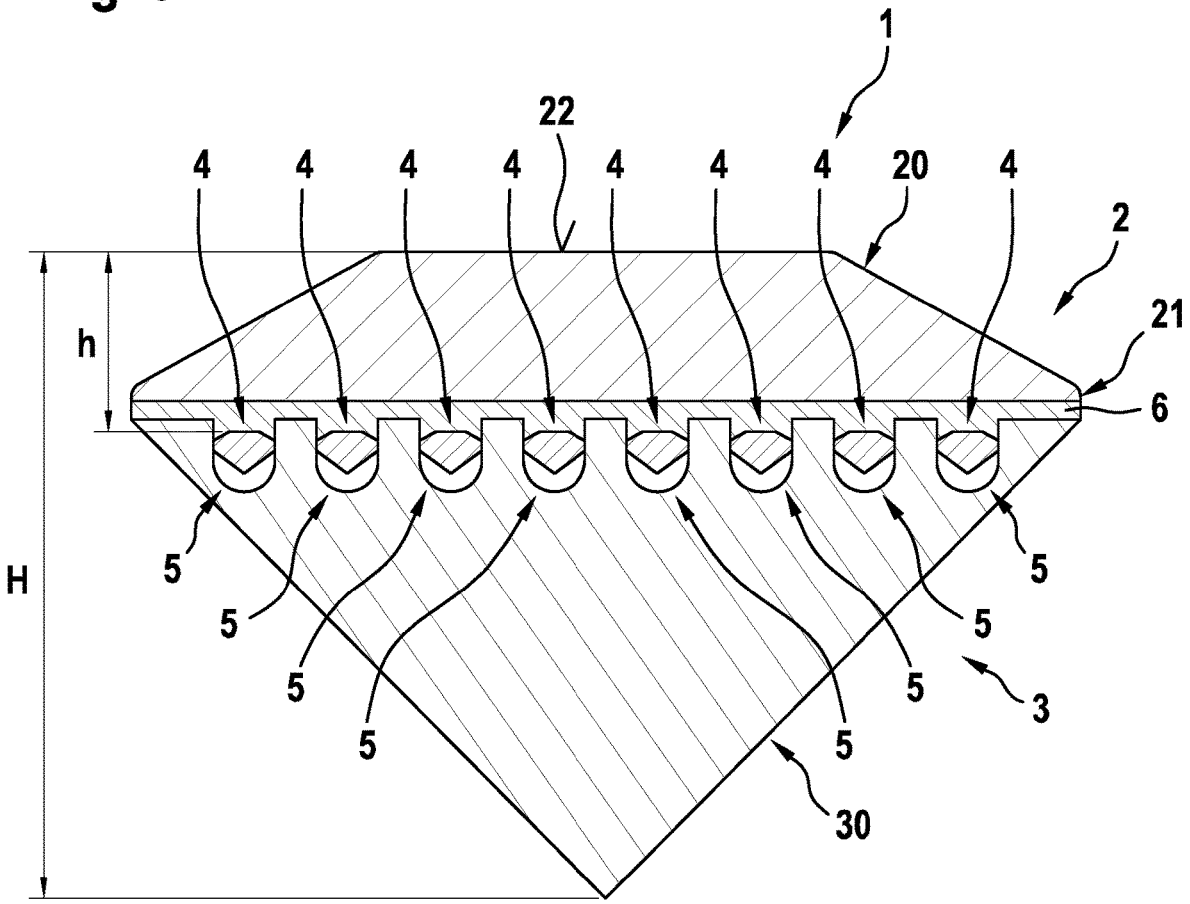
Figure 6:
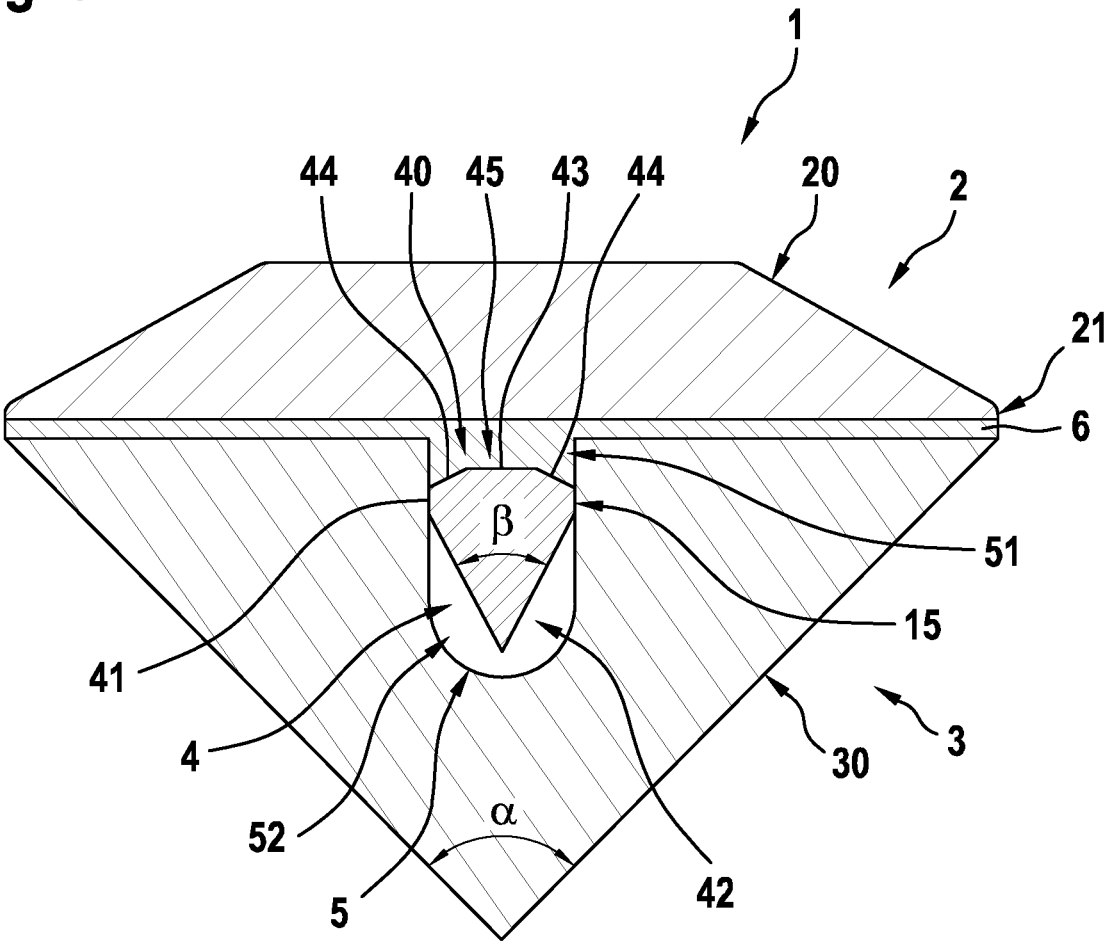
Figure 7:
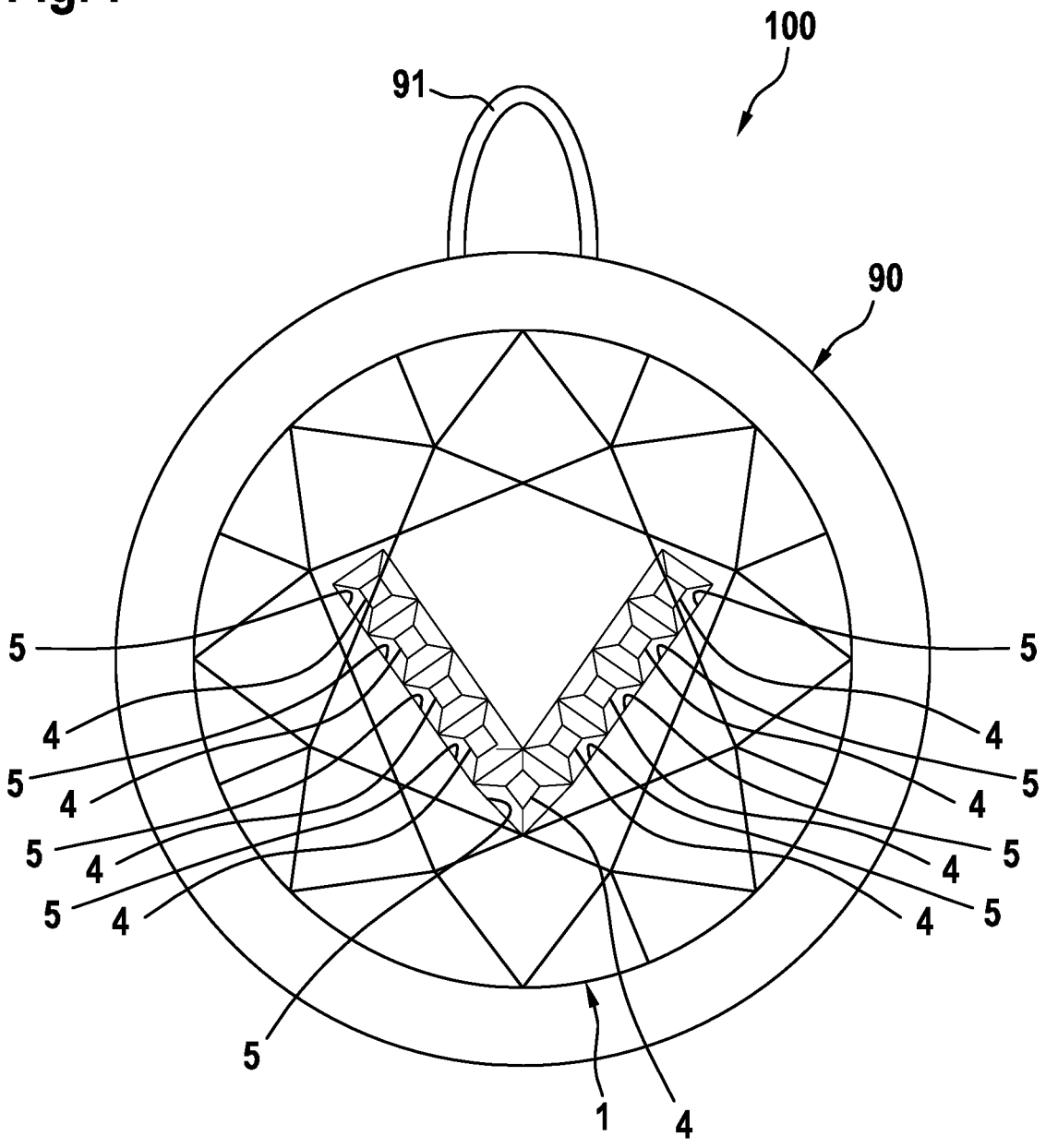

Further details, advantages and features of the present invention can be gathered from the following description of embodiments with reference to the drawing, in which identical, or rather functionally identical, parts are each denoted by the identical reference sign. In the drawing:

FIG. 1 shows a simplified schematic sectional view of a gemstone arrangement according to a first embodiment of the present invention, FIG. 2 shows a simplified schematic sectional view of a gemstone arrangement according to a second embodiment of the present invention, FIG. 3 shows a simplified schematic sectional view of a gemstone arrangement according to a third embodiment of the present invention, FIG. 4 shows a simplified schematic sectional view of a gemstone arrangement according to a fourth embodiment of the present invention, FIG. 5 a simplified schematic sectional view of a gemstone arrangement according to a fifth embodiment of the present invention, FIG. 6 shows a simplified schematic sectional view of a gemstone arrangement according to a sixth embodiment of the present invention, and FIG. 7 shows a simplified schematic top view of a jewel, which comprises a gemstone arrangement according to a seventh embodiment of the present invention.

Subsequently, a gemstone arrangement 1 according to a first embodiment of the present invention is described in detail with reference to FIG. 1.

As can be seen from FIG. 1, the gemstone arrangement 1 comprises a first gemstone element 2, a second gemstone element 3 and a decorative element 4. The decorative element 4 is arranged completely in a recess 5 between the first gemstone element 2 and the second gemstone element 3, wherein the decorative element 4 is implanted in the gemstone arrangement 1.

In this case, the recess 5 is formed completely (only) in the second gemstone element 3. However, it is also possible that the recess 5 is formed partly in the first gemstone element 2 and partly in the second gemstone element 3.

In particular, the decorative element 4 is a precious stone or rather a diamond. Other precious stones, gemstones or metal inlays can however also be used as the decorative element 4.

The second gemstone element 3 is directly connected to the first gemstone element 2 by means of a connecting intermediate layer 6. The gemstone elements 2, 3 are also directly connected to one another over an entire surface. The intermediate layer 6 can in particular be formed as an adhesive film, a laminating film, an adhesive or another connecting substance. The intermediate layer 6 is arranged between the first gemstone element 2 and the second gemstone element 3. Thus, a seamless air-tight joint results between the two gemstone elements 2, 3.

Advantageously, an upper portion 40 of the decorative element formed as a precious stone is embedded in the intermediate layer 6. The upper portion 40 of the decorative element 4 preferably comprises a table 43 and/or crown facets 44 of the precious stone or rather corresponds to a crown 45 of the precious stone. The table 43 or the crown facets 44 correspond to a region of the upper portion 40 of the decorative element 4.

Thus, the upper portion 40 of the decorative element 4 is in direct contact with the intermediate layer 6.

Preferably, the recess 5 and the decorative element 4 have complementary shapes at a contact area 15 between the decorative element 4 and the recess 5. In this embodiment, the contact area 15 corresponds to a girdle 41 of the precious stone. The girdle 41 separates the upper portion 40 from a lower portion (pavilion) 42 of the precious stone.

Below the contact area 15, a region 52 of the recess 5 has only vacuum or air. On the other hand, a region 51 of the recess 5 above the contact area 15 is filled in an advantageous manner with material of the intermediate layer 6. The region 52 below the contact area 15 corresponds to a lower region of the recess 5, wherein the region 51 above the contact area corresponds to an upper area of the recess 5. Here, the crown 45 of the gemstone faces toward the upper region 51 of the recess 5 and the pavilion 42 of the gemstone faces toward the lower region 52 of the recess.

Due to this configuration, an overall improved visual appearance of the gemstone arrangement 1 is achieved.

This is firstly because the upper part 45 of the gemstone is not in an air pocket. This means that the crown 45 of the gemstone is not surrounded by air. As a result, fewer reflections occur on the surface of the gemstone, and light falling on the gemstone can enter the gemstone more freely. Furthermore, due to the intermediate layer (lamination compound) which abuts on the crown 45 and which also represents an optical medium, the refractive index and thus also the total reflection angle are reduced compared to the case, in which the crown 45 were surrounded by air. This facilitates the unobstructed exit of the light at the crown 45, which is important for the sparkle of the gemstone.

Secondly, the air located in the lower region 52 of the recess 5 or the vacuum being present allows the light in the lower portion 42 of the gemstone 4 to be totally reflected twice at the interface between the gemstone 4 and the air. This is possible because air or vacuum has a much lower optical density than the gemstone. Because of the large difference between the optical density of air/vacuum and of the gemstone, the total reflection angle, which indicates the angle within which a total reflection of light occurs, is high. This means that in the case of a high angle of total reflection, the intensity of the luminescence or of the sparkle of the gemstone is also high.

The first gemstone element 2 and the second gemstone element 3 are formed from the same gemstone material in this case. For example, the gemstone elements 2, 3 are each formed from topaz, amethyst, citrine or rock crystal.

Furthermore, the first gemstone element 2 is formed in such a way that it has a crown 20 and a girdle 21. In addition, the second gemstone element 3 is designed in such a way that it has a pavilion 30.

For providing the first gemstone element 2 and the second gemstone element 3, a gemstone can be divided. In doing so, the first gemstone can be divided into two parts, wherein the first part comprises, for example, a crown and a girdle and the second part a pavilion of the gemstone. Of these, the first part of the gemstone can be used as the first gemstone element 2 and the second part of the gemstone can be used as the second gemstone element 3. It is also possible that a first gemstone is used for providing the first gemstone element 2 and a second gemstone for providing the second gemstone element 3, each of which is divided into two parts and of which one of the resulting parts is used. This can be advantageous, for example, when a gemstone has an inclusion, so that only a part thereof can be used as the first or the second gemstone element.

After the recess 5 has been made in the second gemstone element 3, the decorative element 4 is inserted into the recess 5 and the two gemstone elements 2, 3 are connected directly to one another by means of the intermediate layer.

Thus, the gemstone arrangement 1, in which a decorative element 4 is embedded, is created. In this case, the gemstone arrangement corresponds to a gemstone, in which a diamond is implanted and which thus has a completely new appearance.

FIG. 2 shows a gemstone arrangement 1 according to a second embodiment.

The gemstone arrangement 1 comprises like that of FIG. 1 a first gemstone element 2, a second gemstone element 3 and a decorative element 4, which is a gemstone, in particular a diamond, and arranged in a recess 5 formed completely in the second gemstone element 3. The first gemstone element 2 is directly connected to the second gemstone element 3 by means of a connecting intermediate layer 6, wherein an upper portion 40 of the decorative element 4 is in direct contact with the intermediate layer 6.

In the second embodiment, the precious stone is arranged in the recess 5 such that the upper part 45 (crown), the girdle 41 and a region of the pavilion 42 of the precious stone 4 project above the plane of the second gemstone element 3. Here, the crown 45, the girdle 41 and the region of the pavilion 42, which is located above the plane of the second gemstone element 3, correspond to the upper portion of the decorative element 4. The contact between the precious stone and the recess 5 thus takes place in the pavilion 42 of the precious stone.

This arrangement of the precious stone in the recess 5 contributes to that the penetration of the intermediate layer 6 into the region 52 of the recess 5 below the contact area 15 between the recess 5 and the gemstone is prevented. Furthermore, the recess 5 and the precious stone can preferably have complementary shapes at the contact area 15. This can be carried out, for example, by chamfering the recess 5. The region 52 of the recess 5 below the contact area 15 corresponds in this embodiment to the complete (free) recess 5, i.e. the region of the recess 5 not occupied by the precious stone.

The gemstone arrangement 1 according to the second embodiment differs from that of the first embodiment also in that the first gemstone element 2 has a first color and the second gemstone element 3 a second color, which are different from each other.

In addition, the gemstone element 2 and the second gemstone element 3 are formed from different gemstone materials, so that the first gemstone element 2 and the second gemstone element 3 have different refractive indices. In particular, the first gemstone element has a refractive index that is smaller than a refractive index of the second gemstone element.

Furthermore, the decorative element 4 formed as a precious stone has per se a third color which differs from the first and the second color. The precious stone also has a refractive index that is higher than the refractive index of the first gemstone element.

Due to the different colors of the gemstone elements 2, 3, the gemstone arrangement 1 can appear with a different color than the first and second color. Furthermore, due to the different colors of the first gemstone element 2 and the decorative element 4 formed as a precious stone, the decorative element 4 is colored with a another color than its original color without artificial processing. Especially when the precious stone is colorless, this appears with the first color of the first gemstone element 2. In other words, the precious stone looks as if it actually had per se the first color of the first gemstone element 2.

In addition, due to the smaller refractive index of the first gemstone element 2 in comparison to the second gemstone element 3, an improved light yield is achieved. The higher refractive index of the decorative element 4 formed as a precious stone in comparison to the first gemstone element 2 has the advantage that the gemstone arrangement 1 shines more.

It becomes apparent from this that optical effects which could never be achieved with a single gemstone (without an embedded gemstone, in this case a precious stone) can be achieved by the design of the gemstone arrangement 1 according to the second embodiment.

For producing the gemstone arrangement 1, a first gemstone and a second gemstone can each be divided into two parts, of which the one part of the first gemstone is used as the first gemstone element 2 and the one part of the second gemstone is used as the second gemstone element 3.

Alternatively, a first gemstone element and a second gemstone element can be connected directly to each other by means of the connecting layer in order to form an arrangement, wherein the arrangement is subsequently cut. Before the connecting step, the first gemstone element and the second gemstone element are elements of gemstones not cut, but sectioned, in particular in block form. It should be noted that the decorative element 4 is inserted into the recess before the connecting step.

In FIG. 3, a gemstone arrangement 1 according to a third embodiment of the present invention is shown.

In contrast to the gemstone arrangements 1 of FIGS. 1 and 2, a decorative element 4 in the form of a metal inlay is provided in the gemstone arrangement 1 of the third embodiment.

The decorative element 4 is also here completely placed in the recess 5 formed in the second gemstone element 3, wherein the first gemstone element 2 and the second gemstone element 3 are directly connected to one another by means of the connecting intermediate layer. However, in comparison to the previous designs, it is not only an upper part of the decorative element 4 that is in direct contact with the intermediate layer 6, but the complete decorative element 4. In other words, the decorative element 4 is completely embedded in the intermediate layer 6 or rather surrounded by the intermediate layer 6.

FIG. 4 shows a gemstone arrangement 1 according to a fourth embodiment of the present invention.

Here, a carrier element 7 in the form of a glass part 70 is arranged between the first gemstone element 2 and the second gemstone element 3. The recess 5 of the gemstone arrangement 1, in which the decorative element 4 is located, is formed in the glass part 70. The glass part 70 is further connected to the first gemstone element 2 and the second gemstone element 3, so that the decorative element 4 is embedded in the gemstone arrangement 1.

In particular, the glass part 70 is connected to the first gemstone element 2 by means of a connecting intermediate layer 8, wherein a region of an upper portion 40 of the decorative element 4 is in direct contact with the intermediate layer 8.

Advantageously, an upper portion 40 of the decorative element 4 formed as a precious stone is embedded in the intermediate layer 8. The upper portion 40 of the decorative element 4 preferably comprises a table 43 and/or crown facets 44 of the precious stone or rather corresponds to a crown 45 of the precious stone. Here, the table 43 or the crown facets 44 correspond to a region of the upper portion 40 of the decorative element 4.

Preferably, the recess 5 and the decorative element 4 have complementary shapes at a contact area 15 between the decorative element 4 and the recess 5. In this embodiment, the contact area 15 corresponds to a girdle 41 of the precious stone. The girdle 41 separates the upper portion 40 from a lower portion (pavilion) 42 of the precious stone.

Below the contact area 15, a region 52 of the recess 5 has only vacuum or air. On the other hand, a region 51 of the recess 5 above the contact area 15 is in an advantageous manner filled with material of the intermediate layer 8. The region 52 below the contact area 15 corresponds to a lower region of the recess 5, wherein the region 51 above the contact area corresponds to an upper region of the recess 5. Here, the crown 45 of the precious stone faces toward the upper region 51 of the recess 5 and the pavilion 42 of the precious stone toward the lower region 52 of the recess.

Furthermore, the glass part 70 is connected to the second gemstone element 3 by means of a further connecting intermediate layer 9.

The intermediate layer 8 and the further connecting intermediate layer 9 can each be formed, in particular, as an adhesive film, a laminating film, an adhesive or another connective substance.

Furthermore, the first gemstone element 2 is formed in such a way that it has a crown 20. Furthermore, the second gemstone element 3 is formed in such a way that it has a pavilion 30. Here, the carrier element 7 corresponds to a girdle 21.

By providing a carrier element 7, in this case a glass part 70, the method for producing the gemstone arrangement 1 is simplified.

In FIG. 5, a gemstone arrangement 1 is presented according to a fifth embodiment of the present invention.

The gemstone arrangement 1 according to the fifth embodiment essentially corresponds to that of FIG. 1.

These differ in that, according to the fifth embodiment, a plurality of decorative elements 4 formed as gemstones is arranged in the gemstone arrangement 1.

To this end, a plurality of recesses 5 formed completely in the second gemstone element 3 is provided, wherein in each recess 5 one decorative element 4 is arranged.

All the decorative elements 4 are formed identically. This means that all the decorative elements 4 are formed from the same material and have the same color, size and shape. In particular, the decorative elements 4 are white (colorless transparent) brilliants. Accordingly, the recesses 5 for receiving the brilliants are formed identically.

A further difference between the gemstone arrangement of FIG. 1 and the gemstone arrangement 1 according to the fifth embodiment is that in the gemstone arrangement 1 according to the fifth embodiment the first gemstone element 2 and the second gemstone element 3 have a smaller refractive index than the refractive index of the brilliants. It should be noted that the first gemstone element 2 and the second gemstone element 3 are composed of the same precious stone material as in the gemstone arrangement 1 of FIG. 1. Furthermore, the first gemstone element 2 and the second gemstone element 3 have a color (the same color) that is different from the "white" (colorless transparent) color of the brilliants. For example, the first gemstone element 2 and the second gemstone element 3 are sapphire parts.

The brilliants are further arranged in a common plane at the same height h, wherein the height h is measured from an upper surface 22 of the gemstone arrangement 1.

The arrangement of each brilliant in the associated recess 5 corresponds to that of the decorative element 4 in the gemstone arrangement 1 of FIG. 1.

The gemstone arrangement 1 is lightened due to the higher refractive index of the brilliants.

When the height h, at which the diamonds are located, is ⅓ of a total height of the gemstone arrangement 1, the color filter effect of sapphire is reduced so that the gemstone arrangement 1 has a new radiant color.

FIG. 6 shows a gemstone arrangement 1 according to a sixth embodiment of the present invention.

The gemstone arrangement 1 according to the sixth embodiment corresponds essentially to that of FIG. 1.

The basic difference lies in that in the gemstone arrangement 1 according to the sixth embodiment, the gemstone formed as a decorative element 4 has a smaller pavilion angle β than the pavilion angle α of the second gemstone element 3 or rather of the gemstone arrangement 1 and that the first gemstone element 2 and the second gemstone element 3 have a common color.

Particularly preferably, the decorative element, the first gemstone element and the second gemstone element are composed of the same gemstone material, so that also the gemstone formed as the decorative element 4 has the same color. In particular, the decorative element, the first gemstone element and the second gemstone element are composed of a gemstone material, the sparkle of which is proportional to the pavilion angle of a gemstone formed from this material.

Due to the steeper pavilion angle β of the embedded gemstone compared to the pavilion a of the gemstone arrangement 1, the light yield, the sparkle and the luminescence of the gemstone arrangement 1 are improved.

In FIG. 7, a jewel 100 that has a gemstone arrangement 1 according to a seventh embodiment and a setting 90 for receiving the gemstone arrangement 1 is shown. The jewel 100 is in this case a pendant for a chain. For this purpose, the setting 90 has a region 91, by way of which the jewel 1 can be affixed to the chain. However, the jewel 100 can also be a ring, a bracelet, an earring or the like.

Here, a plurality of decorative elements 4 is implanted in the gemstone arrangement 1, which are formed as gemstones. The decorative elements 4 are placed in corresponding recesses 5 of the gemstone arrangement 1 in such a way that the decorative elements 4 form the victory symbol. By the targeted positioning of decorative elements 4 within the gemstone arrangement 1, any symbols can be displayed.

It should be noted that, for the sake of illustration, the gemstone arrangements 1 according to the embodiments described above have the shape of a brilliant-cut stone. However, the gemstone arrangement 1 may have the shape of a precious stone with a different cut.

Alongside the written description of the invention documented above, the disclosure of the invention is supplemented by reference hereby being made explicitly to the illustration thereof in FIGS. 1 to 7.

LIST OF REFERENCE SIGNS

1 gemstone arrangement
2 first (upper) gemstone element
3 second (lower) gemstone element
4 decorative element
5 recess
6 connecting intermediate layer between the first and the second gemstone element
7 carrier element
8 connecting intermediate layer between the first gemstone element and the carrier element
9 connecting intermediate layer between the carrier element and the second gemstone element
15 contact area between the decorative element and the recess or rather the wall of the recess
20 crown of the gemstone arrangement

21 girdle of the gemstone arrangement
22 upper surface of the gemstone arrangement/first gemstone element
30 pavilion of the gemstone arrangement
40 upper portion of the decorative element
41 girdle of the gemstone (decorative element)
42 lower portion (pavilion) of the gemstone (decorative element)
43 table
44 crown facets
45 upper part (crown) of the gemstone (decorative element)
51 region of the recess above the contact area
52 region of the recess below the contact area
70 glass part
90 setting
91 region of the setting
100 jewel
α pavilion angle of the gemstone arrangement
β pavilion angle of the gemstone stone (decorative element)

The invention claimed is:

1. A gemstone arrangement comprising:
a first gemstone element,
a second gemstone element, which is connected to the first gemstone element,
a transparent carrier element connected to, and arranged between, the first gemstone element and the second gemstone element, the transparent carrier element having a recess formed within, and
at least one gemstone, which is arranged in the recess of the carrier element between the first gemstone element and the second gemstone element so that the gemstone is embedded in the gemstone arrangement,
wherein a region of the recess has only air or vacuum.

2. The gemstone arrangement according to claim 1, wherein the transparent carrier element is a glass part.

3. The gemstone arrangement according to claim 1, wherein the first gemstone element and the second gemstone element have different colors.

4. The gemstone arrangement according to claim 1, wherein the first gemstone element has a lower refractive index than the second gemstone element.

5. The gemstone arrangement according to claim 1, wherein the first gemstone element and the second gemstone element are formed from the same gemstone material.

6. The gemstone arrangement according to claim 1, wherein the gemstone has a higher refractive index than the first gemstone element and/or the second gemstone element.

7. The gemstone arrangement according to claim 6, wherein the gemstone is arranged at a height of ⅓ of the total height of the gemstone arrangement, measured from an upper surface of the gemstone arrangement.

8. The gemstone arrangement according to claim 1, wherein the gemstone has a smaller pavilion angle than the second gemstone element.

9. The gemstone arrangement of claim 1, wherein a region of an upper portion of the gemstone is in direct contact with an intermediate layer and the region of the recess having only air or vacuum is below a contact area between the recess and the gemstone.

10. The gemstone arrangement according to claim 9, wherein the transparent carrier element is connected to the first gemstone element by means of the intermediate layer.

11. The gemstone arrangement according to claim 9, wherein the transparent carrier element is connected to the second gemstone element by means of a further connecting intermediate layer.

12. A method for producing a gemstone arrangement, comprising the steps:
providing a first gemstone element,
providing a second gemstone element,
providing a transparent carrier element having a recess formed within,
providing a gemstone,
arranging the transparent carrier element between, and connecting the transparent carrier element to, the first gemstone element and the second gemstone element, and
arranging the gemstone in the recess of the carrier element between the first gemstone element and the second gemstone element so that the gemstone is embedded in the gemstone arrangement, wherein a region of the recess has only air or vacuum.

13. The method according to claim 12, wherein the first gemstone element and the second gemstone element are from a common gemstone divided into two parts, and are connected to one another after arranging the gemstone between the first gemstone element and the second gemstone element.

14. The method according to claim 12, wherein the first gemstone element and the second gemstone element are connected to one another and then cut.

15. The method of claim 12, wherein a region of an upper portion of the gemstone is in direct contact with an intermediate layer and the region of the recess having only air or vacuum is below a contact area between the recess and the gemstone.

16. A gemstone arrangement comprising:
a first gemstone element,
a second gemstone element, which is connected to the first gemstone element,
a glass part connected to, and arranged between, the first gemstone element and the second gemstone element, the glass part having a recess formed within; and
at least one gemstone, which is arranged in the recess of the glass part between the first gemstone element and the second gemstone element so that the gemstone is embedded in the gemstone arrangement,
wherein a region of an upper portion of the gemstone is in direct contact with an intermediate layer and a region of the recess below a contact area between the recess and the gemstone has only air or vacuum.

* * * * *